United States Patent [19]

Carr

[11] 4,420,390

[45] Dec. 13, 1983

[54] MAGNETIC SEPARATOR FOR PARTICULATES

[76] Inventor: Ronald Carr, 23743 Research Dr., Farmington, Mich. 48024

[21] Appl. No.: 342,154

[22] Filed: Jan. 25, 1982

[51] Int. Cl.[3] ..... B03C 1/14

[52] U.S. Cl. ..... 209/216; 209/223 A; 209/229

[58] Field of Search ..... 209/223 A, 223 R, 216, 209/214, 229, 219

[56] References Cited

U.S. PATENT DOCUMENTS

| | | | |
|---|---|---|---|
| 434,588 | 8/1890 | Edison et al. | 209/223 A |
| 500,604 | 7/1893 | Payne | 209/214 |
| 634,356 | 10/1899 | Kreuser | 209/219 |
| 739,741 | 9/1903 | Sweet | 209/223 A |
| 1,048,824 | 12/1912 | Griffiths | 209/229 |
| 2,315,712 | 4/1943 | Jacobson | 209/223 A X |
| 2,631,687 | 3/1953 | Dohrer | 55/430 X |
| 3,045,822 | 7/1962 | Cavanagh | 209/219 |
| 3,146,191 | 8/1964 | Greenwald | 209/223 R |
| 3,421,666 | 1/1969 | Lawson | 209/223 R X |
| 3,450,139 | 6/1969 | Pietrucci | 55/430 X |
| 3,489,281 | 1/1970 | Pierre | 209/223 R |
| 3,763,631 | 10/1973 | Horn et al. | 55/400 X |
| 4,157,955 | 6/1979 | Spodig | 209/219 |
| 4,179,883 | 12/1979 | Nishiyama et al. | 55/276 X |

FOREIGN PATENT DOCUMENTS 149952 2/1903 Fed. Rep. of Germany ..... 209/219

*Primary Examiner*—Kathleen J. Prunner

*Attorney, Agent, or Firm*—Cullen, Sloman, Cantor, Grauer, Scott & Rutherford

[57] ABSTRACT

A magnetic separator for particulates containing prime material and ferrous particles includes a housing having a removable cover having a central throated inlet along its length. A pair of vertically and laterally displaced hollow metallic rolls are journaled upon the end walls and extend the length of the housing, and enclose an elongated semi-cylindrical permanent magnet within each roll, the magnets being of opposite polarity. A pair of elongated, vertically and laterally displaced flow control dampers extend along the length of the housing and are pivotally mounted thereon and define with the inlet and rolls a vertical first feed path for the particulates. A first elongated hopper underlies the first flow path and has an elongated outlet overlying a first conveyor for receiving and delivering prime materials from the housing. Second and third elongated hoppers are arranged upon opposite sides of the first hopper under the rolls respectively. Additional conveyors underlie the second and third hoppers for delivering ferrous particles outwardly of the housing. Elongated opposed roll shaft receiving slots are formed in the end walls to facilitate roll replacement.

13 Claims, 2 Drawing Figures

MAGNETIC SEPARATOR FOR PARTICULATES

BACKGROUND OF THE INVENTION

Present magnetic separators on the market today include radial and longitudinal north and south poles upon each roll between which particulates containing prime material and ferrous particles are passed for the purpose of separating the ferrous particles from the prime material. The use of magnetic separator rolls containing north and south poles do not effectively separate the ferrous particles from the prime material. Strong magnetic forces magnetize the ferrous material particulates north and south so that as the particulates fall from the first roll to the second roll, the respective rolls will repel a certain amount of the oppositely charged ferrous particles and allow them to pass through the flow path since like poles repel. The south pole upon one roll attracts some of the ferrous materials that have been magnetized north. The north pole upon the other roll attracts some of the materials magnetized south.

By providing rolls in a magnetic separator, each of opposite polarity, as the mixture of particulates containing prime material and ferrous particles engage the uppermost roll the ferrous materials are all magnetized north for example and the lower roll all south or negative. As the particulates drop, the ferrous particles therein will be attracted to the lower roll and removed from the flow path of the prime material.

Heretofore particulates containing prime materials and ferrous particles are already run over other magnetic rolls such as in grinding and regrinding processes. Accordingly, the ferrous particles may be either positively or negatively magnetized. Accordingly, when the particulates descend upon the upper magnetic roll some of the ferrous particles will be attracted and some will be repelled. Similarly, as the remaining particulates drop past the second magnetized roll again, some of the ferrous particulates will be repelled and some will be attracted.

SUMMARY OF THE INVENTION

An important feature of the present invention is to provide a magnetic separator which includes a pair of vertically and laterally displaced magnetic rolls each of different polarity so that as the mixture of particulates drops upon the upper roll, which for example has been magnetized all north, the ferrous particles should all be magnetized north. Accordingly, as the particulates drop upon the second roll of opposite polarity, the ferrous particulates will be attracted thereto and will be removed from the main flow path of the prime material.

A further feature is the provision within the magnetic separator of a pair of such rolls which are of opposite polarity so that some of the ferrous particles within the mixture to be separated are attracted to the uppermost roll and the remainder of the ferrous particles will be successively attracted to the lowermost roll of opposing polarity. Both of the rolls perform the separating function. The exact polarity of the ferrous particles within the mixture to be magnetically separated cannot always be predetermined.

A further feature of the present invention is to provide a first hopper within and along the length of the housing having a converging outlet and arranged in the flow path of the prime material. There is provided therebelow a first conveyor within the housing and along its length underlying the first hopper and projecting outwardly of the end walls of the housing for delivering the prime material outwardly of the housing.

A further feature incorporates second and third hoppers within the housing arranged upon opposite sides of the first hopper extending the length of the housing. The respective hoppers have constricted outlets adapted for delivering ferrous particles to the corresponding underlying second and third conveyors. These are arranged within the housing for transmitting separated ferrous particles outwardly thereof.

The present magnetic separator is covered to provide against contamination of the particulates as they pass through the housing for the separation process and to utilize the independent hoppers and conveyors for a fast automated material handling and for transmitting the separated prime material and the separated ferrous particles outwardly of the housing. This avoids clog-ups and down time wherein the machine is continuously operable reducing the expense of operation.

A further feature of the present invention is to provide a novel mounting for the respective magnetic rolls wherein a stationary support shaft is mounted upon the housing and has mounted thereon an elongated semi-cylindrical permanent magnet over which the elongated role is positioned and rotates.

This eliminates the large outside unsafe sprockets and chains and guards heretofore employed which are costly, and eliminates the use of a large shaft with a hole bored through the length thereof to contain a second inside shaft to provide coaxial mounting for the permanent magnets and the rolls.

A further feature incorporates a direct gear reduction motor with variable electronic r.p.m. drive connected to the respective rolls for driving the same at various speeds depending upon the materials processed.

A further feature is to provide an elongated stationary support shaft for each roll and for the permanent magnet therein and wherein a drive shaft is coaxially arranged with respect to the support shaft which serves the function of rotatively driving the rolls and at the same time supporting the free end of the role support shaft within the roll.

A further feature provides a novel and improved construction for an elongated permanent magnet of semi-cylindrical form which is non-rotatively mounted and supported within each roll upon a support shaft.

A further feature includes the use of positive flow control dampers which extend along the length of the housing and which are pivotally mounted thereon and define with the housing inlet and the rolls a primary flow path for the particulates passing through the housing and into the hoppers therein. The flow control dampers may be adjustably positioned between fully open and fully closed position and intermediate positions relative to and further defining the primary flow path for the particulates.

A further feature incorporates into the present magnetic separator opposed pairs of elongated upright slots in the respective end walls for receiving the support shafts for the corresponding rolls and to provide a means by which the rolls may be enclosed during operation in a dust proof housing. This permits the user to pull out the rolls through the top thereof without dismantling the cabinet for cleaning or repair. This requires only a few minutes, such as might be required for changing from one type of material to another as for example, toxic or non-toxic materials wherein the rolls need to be replaced.

A further feature of the present invention is to provide rolls which contain stainless steel sleeves and are therefore non-magnetic and which include support discs of aluminum which are non-magnetic and which are supported and journaled upon the housing and upon the corresponding support shafts for insulating the magnetic assembly and to avoid grounding out of the permanent magnets.

These and other features and objects will be seen from the following specification and claims in conjunction with the appended drawings.

THE DRAWINGS

Figure 1:
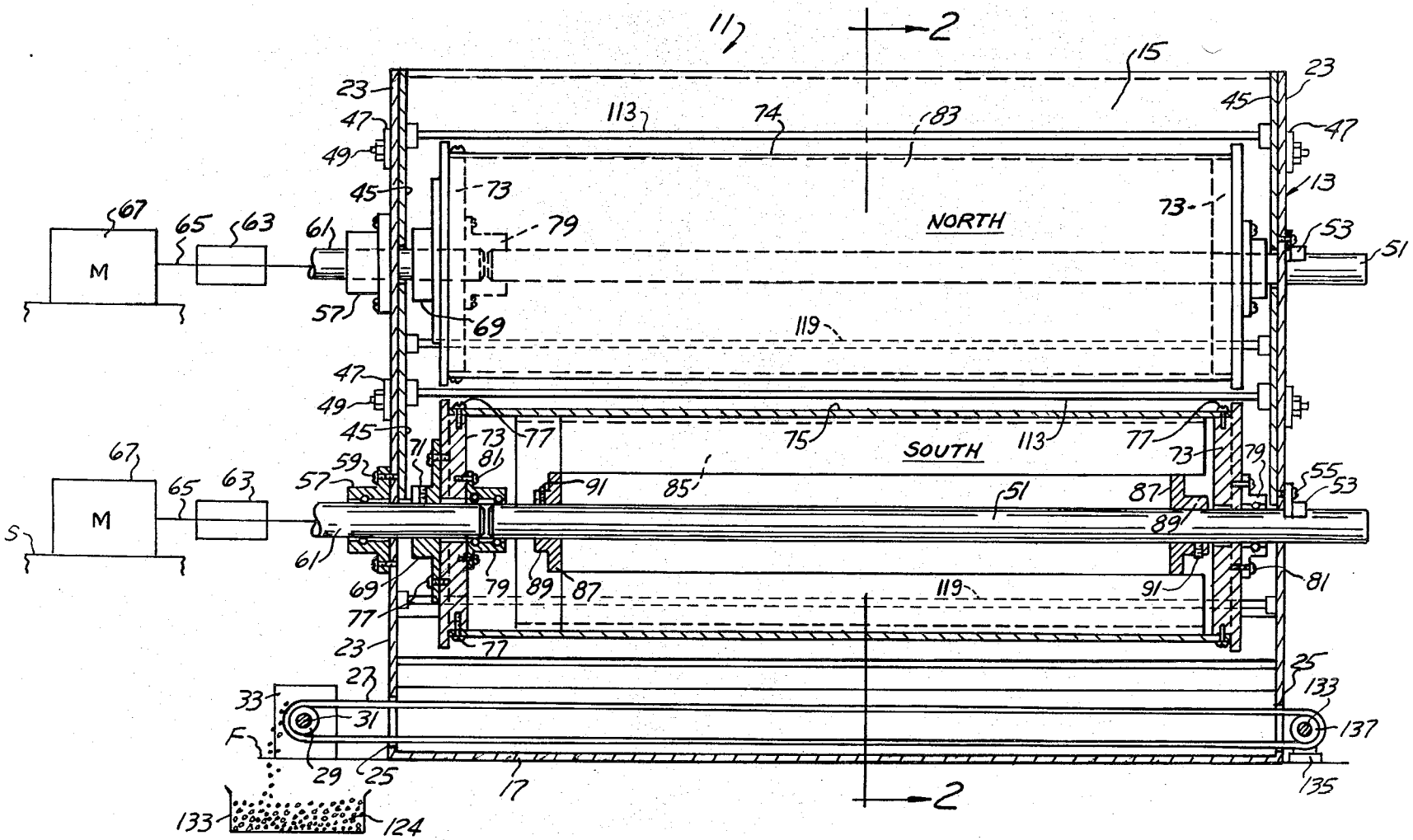
FIG. 1 is a side elevational view partly in longitudinal section of the present magnetic separator.

It will be understood that the above drawings illustrate a preferred embodiment of the invention, and that other embodiments are contemplated within the scope of the claims hereafter set forth.

DETAILED DESCRIPTION OF AN EMBODIMENT OF THE INVENTION

Referring to the drawings, the present magnetic separator is generally indicated at 11 and is adapted for the separation of particulates containing prime material and ferrous particles. The particulates may be of prime material such as grain or flour or chemicals wherein there is contained, as a characteristic of the production process, ferrous particles which must be removed by the present separator for providing relatively pure prime material free of such ferrous particles. Other examples of particulate materials which may be effectively passed through the present magnetic separator include cereals, grains, such as rice or other food products, or other particulate products wherein it is essential that the ferrous particles therein be removed, including liquids.

Figure 2:
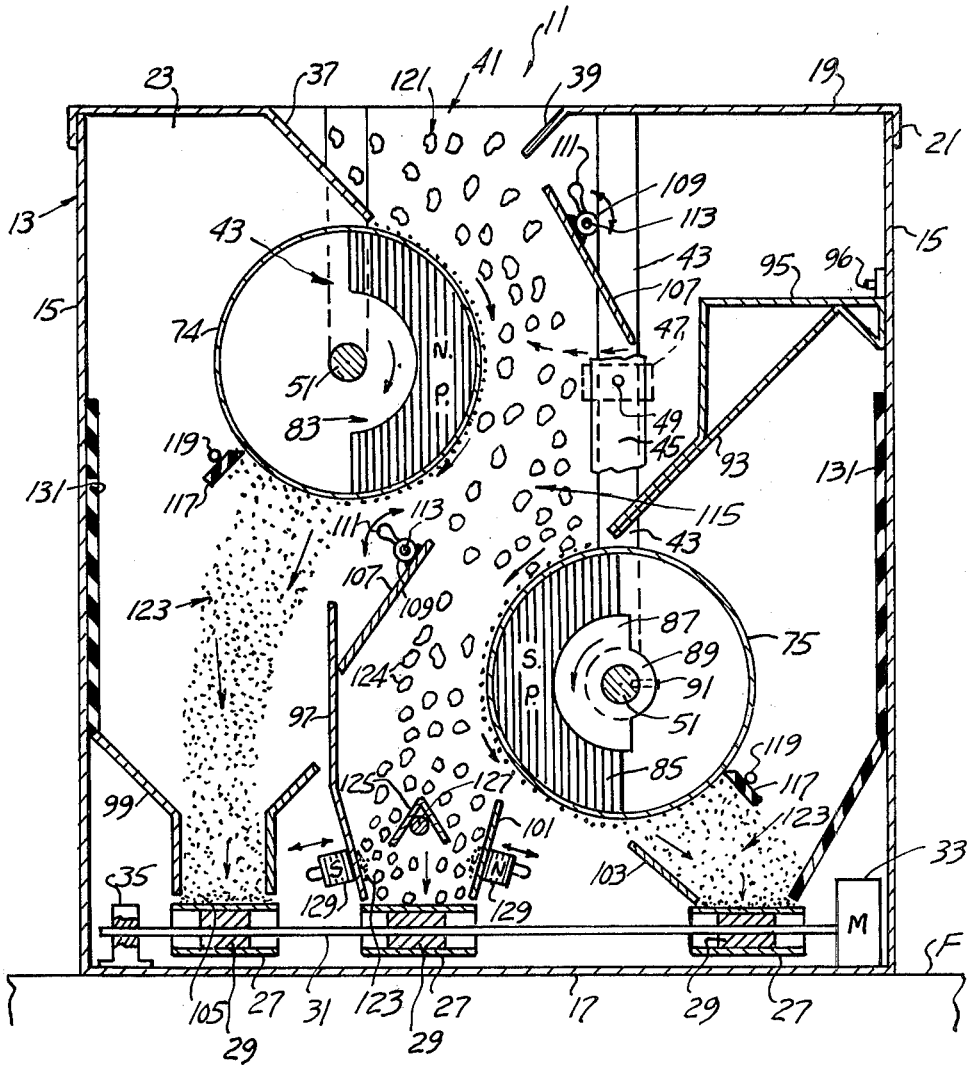
FIG. 2 is a vertical section taken in the direction of arrows 2—2 of FIG. 1.

The present magnetic separator includes an elongated cabinet or housing 13 having spaced side walls 15, a bottom wall 17 adapted for positioning upon a floor or other support F, and a removable cover 19 having a depending peripheral flange 21 (FIG. 2).

The housing includes a pair of opposed end walls 23 having formed therein at the opposite ends thereof a series of laterally spaced conveyor outlets 25, there being six in number in the present illustrative embodiment. A plurality of parallel laterally spaced conveyors 27 extend through the housing above the bottom wall 17 thereof and project from opposite ends thereof through the corresponding apertures 25.

The conveyors 27 are sometimes hereafter referred to as the first, second and third conveyors. The forward ends of the conveyors outwardly of the housing receive the transverse drive shaft 31 (FIG. 1) connected to the motor 33 mounted upon the floor surface F. The series of laterally spaced drive rollers 29 are secured upon shaft 31 and are in supportive driving engagement with the respective conveyors. The free end of shaft 31 is supported upon the bearing block 35 mounted upon the floor surface F as shown schematically in FIG. 2.

As shown in FIG. 1, the opposite ends of the respective conveyors 27 are supported upon a series of corresponding laterally spaced idler rollers 137 supported upon the transverse shaft 133 mounted upon a pair of laterally spaced journal blocks 135.

Formed within the removable cover 19 is a centrally arranged elongated throated inlet opening 41 defined by elongated inlet plate 37 which is inclined downwardly from cover 19 and extends substantially the length of said housing. Its lower longitudinal edge is closely adjacent the top central portion of the upper roll 74.

The plate 37 is inclined angularly downward at an acute angle of approximately 45° with respect to the cover 19. The inlet opening is further defined by the spaced oppositely extending inclined elongated plate 39 which extends angularly inward from the cover 19 at an acute angle of 45° approximately thereto and is spaced from the first plate 37 defining a throated opening 41 which receives the particulate mixture 121 (FIG. 2) which contains prime material particulates 124 and ferrous particles 123.

Opposed pairs of upright end wall slots 43 formed within the end walls 23 of housing 13 are adapted for receiving the roll support shafts 51 and drive shafts 61.

The shaft ends are projected through and along the respective slots 43 to the position shown in FIG. 2. In normal use, the respective slots are closed by the elongated upright slot covers 45 which bear against the interior surfaces of the ends walls and are secured thereto by the fasteners 49 mounting the exterior cover clips 47 (FIGS. 1 and 2).

In normal operation of the magnetic separator, the rolls 74–75 are completely enclosed within the housing and can be removed from the housing merely by lifting the cover 19 and temporarily removing the slot covers 45 without otherwise disturbing the construction internally of the separator such as shown in FIGS. 1 and 2.

The mountings for the respective rolls, 74 and 75 are the same and each includes an elongated roll support shaft 51 (FIG. 1) which at one end projects through one end wall 23 of the housing and is non-rotatively secured thereto by the key anchor 53 and corresponding fastener 55. Ball bearing 57 is arranged coaxially of shaft 51 and is mounted upon the other end wall 23 and is secured thereto by fasteners 59.

Drive shaft 61, fragmentarily shown, is connected by adapter 63 to the output shaft 65 of the motor 67 mounted upon a suitable support S, FIG. 1. In the illustrative embodiment, the motor 67 is a gear reduction motor which operates, for illustration at 49 r.p.m., and has a capacity of 0.5 horsepower. The speed of operation of the gear reduction motor can be modified to meet the needs of a particular magnetic separation depending upon the materials to be separated.

Drive shaft 61 is coaxial to and in alignment with support shaft 51 and upon one end inwardly of the end wall 23 mounts an adapter 69 which is secured thereto by the set screw 71. Each of the rolls 74 and 75 include elongated tubes of stainless steel, in the illustrative embodiment of a thickness 1/16 of an inch. Upon their ends they are projected thereinto the roll end insert aluminum discs 73 secured thereto by fasteners 77.

The adapter 69 axially overlies the insert disc 73 and is secured thereto by a plurality of fasteners 77, providing a rotative drive for the rolls 74 and 75. Ball bearing 79 is axially mounted upon disc 73 and secured thereto by fasteners 81, projects into said roll so as to cooperatively receive and support one end of the stationary support shaft 51.

Thus, each magnetic roll is rotatively mounted upon a support shaft 51 and also upon the coaxial drive shaft 61 which serves to rotate the magnetic roll under the control of the gear reduction motor 67 (FIG. 1).

An additional ball bearing 79 is axially mounted upon the other insert roll support disc 73 and suitably secured thereto completing the journal mounting and support of said roll. Nested and spaced within the respective roll 74 and 75 is a semi-cylindrical permanent magnet 83, as shown in FIG. 2 which in use is of C-shape. The magnets are arranged upon the inner one half of the respective rolls, partly defining the particulate flow path 115 (FIG. 2).

The upper permanent magnet is magnetized all north and the lower semi-cylindrical permanent magnet 85 is magnetized all south. Accordingly, the rolls are of opposite polarity. Each magnet adjacent its opposite ends have semi-circular spider supports 87 suitably secured thereto and at their centers have circular hubs 89 which are positioned over the shaft 51 and secured thereto by set screws 91.

Partition 93 is inclined angularly downward and inward from one side wall 15 (FIG. 2), at approximately 45 degrees for illustration and includes a partition support 95 secured to the corresponding side wall by fasteners 96. Partition 93 and its support 95 extend substantially the length of the housing with the lower longitudinal edge of said partition closely adjacent and above the center of the lower magnetic roll 75. A plurality of parallel laterally spaced converging hoppers 99, 101 and 103 are arranged at the lower end of housing 13 spaced above bottom wall 17 and include outlets 105.

A pair of elongated positive flow control dampers 107 extend the length of said housing and include hubs 109 thereon with associated handles 111 positioned upon the longitudinally extending support rods 113 which extend between the end walls 23 of said housing. The positive flow control dampers 107 cooperate with the rolls 74 and 75 and the partition 93 as well as the upright elongated partition 97 forming a part of the central hopper 101 to define the particulate flow path 115. Said path has an inlet 41 at the top of the housing within cover 19.

Each of the respective dampers 107 which extend the length of the housing are adjustable from the fully open position shown to intermediate positions or to a fully closed position adjacent the corresponding roll 74 and 75 for regulating the lateral dimensions of the flow path depending upon the nature of the particulate or the quantities to be passed therethrough. In the illustrative embodiment the respective support rods 113 are secured at their ends upon the end walls 23 of the housing.

A pair of elongated hard rubber wipers 117 are adjustably mounted adjacent lower portions of the respective rolls 74 and 75 and are respectively mounted upon suitable elongated support rods 119 which extend between the end walls 23. The scrapers function to facilitate and to assure that any magnetic particules or ferrous particles in the particulate are separated from the corresponding rolls so as to drop vertically by gravity into the corresponding hopper 99 or 103.

The mixture of particulates and ferrous particles as initially introduced at the inlet 41 are designated at 121 and include ferrous particles 123 which are magnetically separated from the primary mixture by the use of the semi-cylindrical permanent magnets 83, 85 for ultimate disposal through the corresponding hoppers 99 and 103.

The prime material particulates 124 as separated from the ferrous particles remain in the primary flow path 115, moving past the respective dampers 107 past the respective magnetic rolls 74 and 75 into the central hopper 101.

The ferrous particles forming a part of the particulates 121 are generally indicated at 123 and tend to adhere to either of the respective rolls 74 or 75 up at least to the scrapers 117 and are separated therefrom by the combined action of the scraper and by gravity. The magnetic force from the roll surface is lost after the roll has moved past the lower edges of the corresponding permanent magnets 83 and 85.

Arranged centrally of the downwardly converging walls of the central hopper 101 is an elongated angle deflector bar 125 of inverted V-shape which extends the length of the housing and is mounted upon a support rod 127 and suitably secured thereto. The support rod extends between housing end walls 23 and is mounted thereon.

Arranged upon opposite sides of the converging walls of hopper 101 adjacent and below the angle deflector bar 125 are a series of bar magnets 129. Upon one side the bar magnets have a positive or north pole and upon the opposite side a negative or south pole. These bar magnets are retractable or removable as desired.

In operation to the extent that some ferrous particles may have adhered to the particulate or prime material, finally after having passed the lower magnetic roll will impinge upon the angle deflector bar 125 and be mechanically separated from the prime material. In dropping downwardly they will be attracted to the corresponding permanent magnets 129 and will accumulate upon adjacent portions of hopper 101 such as shown at 123.

When there has been sufficient accumulation, or at the end of a run, after the prime material particulate has been removed, the respective permanent magnets 129 are retracted or removed and the ferrous particles 123 will drop down upon the central conveyor 27 or can be scraped off for full removal from the housing.

Upon opposite interior sides of the respective side walls 15 are hard rubber insert panels 131 secured thereto which at their lower ends merge with the inclined walls of the corresponding hoppers 99 and 103. These panels serve as a protection to the side walls 15 against damage or dents from the throwing of ferrous particles thereagainst. Said panels also serve as sound deadeners.

The corresponding conveyors 27 underlie the outlets 105 of the respective hoppers 99, 101 and 103 and are adapted to continuously advance the primary particulate 124 which has been filtered from the central hopper 101 and outwardly of the housing as well as the ferrous particles 123 which fall by gravity through the corresponding outer hoppers 99, 103 and onto the adjacent conveyors therebelow.

Of importance in the present disclosure is that the respective permanent magnets 83, 85 within the corresponding rolls are of different polarity. For example the upper permanent magnet is all north and the lower permanent magnet is all south.

This assures that the ferrous particles 123 within the mixture 121 to be passed through the separator will be attracted to either of the magnetic rolls 74 or 75 depending upon their individual polarity. This assures that most of the ferrous particles 123 in the particulate mixture will be removed and separated from the prime mixture 124. These ferrous particles are collected at the end of the central conveyor as at 133 (FIG. 1).

OPERATION

In operation, at the top, falling ferrous particulates in the particulate mixture 121 containing prime material, except for any residual magnetism therein are magnetized all north as they drop upon the upper roll 74. Some of the ferrous particles 123 do adhere to the roll 74 and drop into the hopper 99. The remaining ferrous particles 123 in the particulate mixture having a north polarity will essentially be attracted to and retained by the lower or south pole roll 75 and thus will be disposed of through the right hand hopper 103.

Since the material during the grinding process may have been run over by other magnetic rolls, the ferrous materials within the particulate mixture will be of different polarity.

However, with the present arrangement of the rolls being of opposing polarity, there is a reasonably good assurance that most, if not all of the ferrous particles will be attracted to one or the other of the two rolls and disposed of through the respective hoppers 99 and 103. The primary material is relatively pure passing through the central hopper 101.

The primary function of making the upper roll all north or all positive means that to a great extent the ferrous material within the mixture of particulates will be assured of being attracted and retained by the lower south polarity roll 75.

The present invention is directed to the use of three built in conveyors within the separator housing delivering the primary materials from one conveyor and discarding the ferrous particles from the other two conveyors in a continuous manner.

The use of the cover 19 protects the materials from contamination and provides for a fast automated handling of the particulates and their separation avoids clog-ups and down time which might be otherwise involved in shutting the machine off from time to time and will save on the cost of operation.

By using the aligned split stationary support shaft system 51 and the power drive shaft 61, the respective rolls 74 and 75 are free to rotate over and outside of the stationary magnets 83 and 85. A unique construction is provided by which the respective magnets are mounted and supported upon the corresponding support shafts 51 in the manner independent of the power drive for the outer rotating rolls.

By the use of the present flow control dampers 107, there is provided a positive flow control for the separator of a given amount of particulate materials to obtain proper allowed production per hour cycle time, superior quality control and wherein the damper flow control may be set at 0.75, 0.50, or 0.25 capacity or fully closed.

The use of the opposed end wall slots 43 permits the user to pull out the roles through the top of the housing without dismantling the cabinet for cleaning or repair and requires only a few minutes. Often times the rolls are changed depending upon the nature of the materials passing through the separator as for example, dangerous, toxic or non-dangerous materials.

The slots are closed by the corresponding removable cover strips 45 upon the interior of the housing and held in place by the corresponding clips 47 and are thus easily removable. The use of the covers 45 furthermore renders the interior of the housing dustproof and fully enclosed.

In the illustrative embodiment the cabinet is made of aluminum and stainless steel.

The permanent magnets 83 and 85 are furthermore insulated from their support shaft 51 by the use of 302 stainless steel spider supports 87 whose corresponding hubs 89 are fixedly secured to the support shaft 51 adjacent opposite ends of the corresponding rolls. This insulates the semi-cylindrical permanent magnets to prevent their grounding out or loss of magnetic power. In the present construction ball bearings are employed at 79 and 57 to provide a better free rolling quality product with respect to the corresponding shafts 51 and 61 to avoid grounding out of magnetic power.

The hard rubber elongated wipers 117 are particularly useful in those cases where the ferrous materials may absorb dampness or static electricity and tend to adhere to the corresponding rolls.

The hard rubber insert liners 131 on the sides of the cabinet prevent damage thereto from dents caused by the magnetic rolls throwing heavy objects that might get into the materials and this also stops the loud noise when this occurs.

A direct drive is provided for the rolls by the use of an adapter 69 which fits onto and is secured to the insulated aluminum insert 73 suitably secured thereto as at 77. This provides a direct drive for the corresponding rolls.

The present conveyors 27 can be extended to the required length and can be covered as desired to match present or future automated production equipment.

The permanent magnets 129 of opposite polarity are adapted to catch any material which may have been embedded within the prime materials for preventing it from falling past the rolls and through the outlet of the central hopper. The angular deflecting bar 125 is effective for jarring loose any ferrous material which might otherwise have been embedded within the primary material and would otherwise escape. These materials are caught by magnets 129.

It is contemplated that the prime material being passed through the magnetic separator may be in liquid form and nevertheless containing a mixture of ferrous particles or particulates which will be removed by the present magnetic separator.

The function and operation of the present separator will be exactly the same as above described with the exception that central or first conveyor 27 will be in the form of a channel underlying the first hopper 101 adapted to receive the descending liquid from which the ferrous particles have been removed and for conveying the liquid outwardly of the housing.

Therefore, the first or centrally arranged conveyor 27 shown in FIG. 2 may be in the form of a downwardly and outwardly inclined channel which underlies the first hopper 101. In all respects, the function and operation of the magnetic separator is the same. Experience has shown that the present magnetic separator is equally effective for the separation of ferrous particles from liquids passed through the separator. Having described my invention, reference should now be had to the following claims:

I claim:

1. A magnetic separator for particulates containing prime material and ferrous particles comprising a housing of predetermined length having end walls, side walls of the same length, a bottom wall and a removable cover of the same length having a central throated inlet along the length thereof;

a pair of parallel, vertically and laterally displaced hollow metallic rolls, each having spaced ends, rotatively mounted and journaled upon said end walls and of a length extending substantially the length of said housing;

an elongated permanent magnet of semi-cylindrical form non-rotatively mounted within each roll, said magnets being of opposite polarity, with their convex surfaces being opposed and arranged along the inner side of each roll;

a pair of elongated, vertically and laterally displaced adjustable flow control dampers extending along the length of said housing, pivotally mounted and supported between said end walls and defining with said inlet and rolls a vertical first flow path;

an elongated first hopper underlying said first flow path extending the length of said housing and having a constricted underlying outlet;

a first conveyor within said housing along its length underlying said first hopper and having spaced ends projecting outwardly of said end walls for delivering prime material outwardly of said housing;

second and third hoppers within said housing along its length spaced from opposite sides of said first hopper underlying said rolls respectively, each hopper having spaced ends and a constricted underlying outlet;

the ferrous particles adhering to said rolls respectively and successively dropping into said second and third hoppers respectively;

and corresponding second and third conveyors within said housing along its length underlying said second and third hoppers respectively and projecting outwardly of said end walls for delivering ferrous particles outwardly of said housing;

said rolls being rotatable relative to said magnets, whereby the magnetic attractive force is continuously applied to ferrous particles within said particulates in said first flow path;

said ferrous particles adhering to said rolls until the corresponding roll surface has moved away from the magnets, releasing said ferrous particles to fall by gravity into the second and third hoppers respectively.

2. In the magnetic separator of claim 1, each roll including an elongated stationary roll support shaft extending the length of and upon the interior of each roll, projecting through one end wall and secured thereto;

an elongated metallic tube receiving said shaft;

non-ferrous roll end support discs projected into the ends of said tube and secured thereto;

axial bearings upon each support disc receiving and mounted upon said support shaft;

and a power rotated drive shaft coaxial with said support shaft, projected through and journaled and supported upon another end wall and supportably extending through one end support disc and secured thereto.

3. In the magnetic separator of claim 2, said drive shaft being aligned with said support shaft and received by the axial bearing upon said one end support disc for supporting one end of said support shaft.

4. In the magnetic separator of claim 1, the mounting of each roll including a stationary roll support shaft extending through each roll, through one end wall and secured thereto;

non-ferrous support discs upon the ends of each roll;

axial bearings upon each disc receiving and supported upon said support shaft;

and a power rotated drive shaft aligned with said support shaft projected through and journaled upon another end wall and supportably extending through one support disc and secured thereto, the bearing upon said latter support disc supportably engaging one end of said support shaft.

5. In the magnetic separator of claim 1, the mounting of each flow control damper including an elongated support rod at its ends mounted upon said housing end walls;

and a handle upon each control damper for selectively rotating each flow control damper between fully open, intermediate and fully closed positions relative to said first flow path.

6. In the magnetic separator of claim 1, radially extending rubber wipers extending the length of and engaging said rolls, spaced from said permanent magnets, and at their ends mounted upon said housing end walls, for stripping and deflecting any ferrous particles from said rolls such that said ferrous particles fall by gravity into the underlying hopper;

said permanent magnets retaining said ferrous particles upon the roll surfaces until said particles have moved away from said magnets for gravity fall into said second and third hoppers respectively.

7. In the magnetic separator of claim 1, said conveyors being parallel and laterally spaced;

idle support means mounting through one of said spaced ends of said conveyors;

drive rollers movably supporting the other ends of said conveyors;

and a motor upon a support having a drive shaft extending through and operatively engaging said drive rollers.

8. A magnetic separator for particulates containing prime materials and ferrous particles comprising a housing of predetermined length having end walls, side walls of the same length, a bottom wall and a removable cover of the same length having a central throated inlet along the length thereof;

a pair of parallel, vertically and laterally displaced hollow metallic rolls, each having spaced ends, rotatively mounted and journaled upon said end walls and of a length extending substantially the length of said housing;

an elongated permanent magnet of semi-cylindrical form non-rotatively mounted within each roll, said magnets being of opposite polarity, with their convex surfaces being opposed and arranged along the inner side of each roll;

a pair of elongated, vertically and laterally displaced adjustable flow control dampers extending along the length of said housing, pivotally mounted and supported between said end walls and defining with said inlet and rolls a vertical first flow path;

an elongated first hopper underlying said first flow path extending the length of said housing and having a constricted underlying outlet;

a first conveyor within said housing along its length underlying said first hopper and having spaced ends projecting outwardly of said end walls for delivering prime materials outwardly of said housing;

second and third hoppers within said housing along its length spaced from opposite sides of said first hopper underlying said rolls respectively, each hopper having spaced ends and a constricted underlying outlet;

the ferrous particles adhering to said rolls respectively and successively dropping into said second and third hoppers respectively;

and corresponding second and third conveyors within said housing along its length underlying said second and third hoppers respectively and projecting outwardly of said end walls for delivering ferrous particles outwardly of said housing;

said rolls being rotatable relative to said magnets, whereby the magnetic attractive force is continuously applied to ferrous particles within said particulates in said first flow path;

said ferrous particles adhering to said rolls until the corresponding roll surface has moved away from the magnets, releasing said ferrous particles to fall by gravity into the second and third hoppers respectively;

said first flow path including a partition extending the length of said housing, connected to one side wall along its length and inclined downwardly at an acute angle with its lower longitudinal edge in spaced registry with the top of the lower roll and underlying one of said control dampers.

9. A magnetic separator for particulates containing prime materials and ferrous particles comprising a housing of predetermined length having end walls, side walls of the same length, a bottom wall and a removable cover of the same length having a central throated inlet along the length thereof;

a pair of parallel, vertically and laterally displaced hollow metallic rolls, each having spaced ends, rotatively mounted and journaled upon said end walls and of a length extending substantially the length of said housing;

an elongated permanent magnet of semi-cylindrical form non-rotatively mounted within each roll, said magnets being of opposite polarity, with their convex surfaces being opposed and arranged along the inner side of each roll;

a pair of elongated, vertically and laterally displaced adjustable flow control dampers extending along the length of said housing, pivotally mounted and supported between said end walls and defining with said inlet and rolls a vertical first flow path;

an elongated first hopper underlying said first flow path extending the length of said housing and having a constricted underlying outlet;

a first conveyor within said housing along its length underlying said first hopper and having spaced ends projecting outwardly of said end walls for delivering prime materials outwardly of said housing;

second and third hoppers within said housing along its length spaced from opposite sides of said first hopper underlying said rolls respectively, each hopper having spaced ends and a constricted underlying outlet;

the ferrous particles adhering to said rolls respectively and successively dropping into said second and third hoppers respectively;

and corresponding second and third conveyors within said housing along its length underlying said second and third hoppers respectively and projecting outwardly of said end walls for delivering ferrous particles outwardly of said housing;

said rolls being rotatable relative to said magnets, whereby the magnetic attractive force is continuously applied to ferrous particles within said particulates in said first flow path;

said ferrous particles adhering to said rolls until the corresponding roll surface has moved away from the magnets, releasing said ferrous particles to fall by gravity into the second and third hoppers respectively;

said first hopper including opposed downwardly converging spaced side walls of a length corresponding to the length of said housing;

an angle deflector bar of inverted V-shape extending the length of said hopper side walls and spaced centrally therefrom, in the path of downward movement of said particulates for impingement therewith for breaking loose any remaining ferrous particles from said prime material, deflecting them laterally;

and a magnetic means upon and along said hopper side walls adjacent said deflector bar for attracting ferrous particles to and retaining said particles upon said hopper side walls.

10. In the magnetic separator of claim 9, said magnetic means including permanent magnets of opposite polarity secured upon the outside of said hopper side walls and extending along their length, the accumulated ferrous particles separated from the particulates and adhered to said hopper side walls, being adapted for separate removal therefrom and adapted to fall upon the adjacent first conveyor for transport out from said housing.

11. A magnetic separator for particulates containing prime materials and ferrous particles comprising a housing of predetermined length having end walls, side walls of the same length, a bottom wall and a removable cover of the same length having a central throated inlet along the length thereof;

a pair of parallel, vertically and laterally displaced hollow metallic rolls, each having spaced ends, rotatively mounted and journaled upon said end walls and of a length extending substantially the length of said housing;

an elongated permanent magnet of semi-cylindrical form non-rotatively mounted within each roll, said magnets being of opposite polarity, with their convex surfaces being opposed and arranged along the inner side of each roll;

a pair of elongated, vertically and laterally displaced adjustable flow control dampers extending along the length of said housing, pivotally mounted and supported between said end walls and defining with said inlet and rolls a vertical first flow path;

an elongated first hopper underlying said first flow path extending the length of said housing and having a constricted underlying outlet;

a first conveyor within said housing along its length underlying said first hopper and having spaced ends projecting outwardly of said end walls for delivering prime materials outwardly of said housing;

second and third hoppers within said housing along its length spaced from opposite sides of said first hopper underlying said rolls respectively, each hopper having spaced ends and a constricted underlying outlet;

the ferrous particles adhering to said rolls respectively and successively dropping into said second and third hoppers respectively;

and corresponding second and third conveyors within said housing along its length underlying said second and third hoppers respectively and projecting outwardly of said end walls for delivering ferrous particles outwardly of said housing;

the mounting of each roll including an axial support shaft extending through each roll, through one end wall and secured thereto;

a power rotated drive shaft aligned with said support shaft journaled through another end wall and supportably secured to each roll at one end thereof;

said end walls having upright opposed pairs of slots of predetermined height therein respectively receiving the support shaft and drive shaft for each roll;

said rolls on removal of said cover and disengagement of said shafts from said end walls being adapted for removal from said housing by lifting said shafts along the height of said slots and outwardly of the housing at its top.

12. In the magnetic separator of claim 11, slot covers mounted over said slots respectively above said rolls and clipped to said housing end walls.

13. In the magnetic separator of claim 12, said slot covers bearing against the interior of said end walls respectively;

and clips mounted upon said covers spanning said slots upon the outside of said end walls and secured thereto.

* * * * *